US006659835B1

(12) United States Patent
Allen

(10) Patent No.: US 6,659,835 B1
(45) Date of Patent: Dec. 9, 2003

(54) INTERACTIVE TOY PHONE

(76) Inventor: Kathy L. Allen, 67 Ridge View Crossing, Newington, CT (US) 06111

( * ) Notice: Subject to any disclaimer, the term of this patent is extended or adjusted under 35 U.S.C. 154(b) by 0 days.

(21) Appl. No.: 10/410,427

(22) Filed: Apr. 9, 2003

(51) Int. Cl.[7] ..... A63H 33/30
(52) U.S. Cl. ..... 446/142; 446/175
(58) Field of Search ..... 446/141, 142, 446/175, 484, 299, 302; 434/219, 308

(56) References Cited

U.S. PATENT DOCUMENTS 4,103,452 A * 8/1978 Wood ..... 46/33
4,266,365 A 5/1981 Cummings et al.
4,707,855 A * 11/1987 Pasinski et al. ..... 379/376
4,866,764 A 9/1989 Barker, III
5,184,971 A 2/1993 Williams
5,382,188 A 1/1995 Tomellini
5,609,508 A 3/1997 Wingate
5,679,049 A 10/1997 Arad et al.
5,681,200 A 10/1997 Schecter
6,056,550 A 5/2000 Richardson

* cited by examiner

*Primary Examiner*—Jacob K. Ackun
*Assistant Examiner*—Jamila Williams
(74) *Attorney, Agent, or Firm*—Dale J. Ream

(57) ABSTRACT

An interactive toy phone includes a handset having a keypad, microphone, and speaker. A CPU connected to a memory module is positioned in the handset, the memory module having a plurality of message storage locations corresponding to the keys of the keypad. The toy phone includes recording and playback modules for recording audio messages in selectable memory locations and for selectively playing those messages stored in memory. The toy phone includes an interface for connecting the handset with a conventional telephone base or telephone line so as to receive conventional telephonic signals. These signals may be selectively recorded for future playback upon actuation of a key corresponding to the memory location in which the message was recorded. The toy phone is programmed to include educational games using recorded message in memory.

18 Claims, 9 Drawing Sheets

Main Menu Routine

Listen Person Mode

Record Person Mode

Identify Person Mode

INTERACTIVE TOY PHONE

BACKGROUND OF THE INVENTION

This invention relates generally to toy phones and, more particularly, to an interactive toy phone that interfaces with a conventional telephone or telephone line such that telephonic signals from the conventional telephone or telephone line may be heard through the toy phone handset or even recorded in memory.

Children desire to play with toys that replicate actual machinery or appliances used by adults. Various toy telephones have been proposed in the art that include lights and predetermined sounds or audible messages. Other toy telephones include tape-recorder type technology for recording an audible message for playback at a later time. Although assumably effective for their intended purposes, the existing devices do not provide a direct interface between a toy telephone handset and a conventional telephone base unit or telephone line that enables telephonic signals to be received and emitted by the handset and selectively recorded for future playback.

Therefore, it would be desirable to have a toy telephone having a handset that interfaces with a conventional telephone base unit or telephone line for receiving conventional telephonic signals. Further, it would be desirable to have a toy telephone that can selectively record conventional telephonic signals. In addition, it would be desirable to have a toy telephone that includes educational games utilizing messages and other data previously recorded in its memory module.

SUMMARY OF THE INVENTION

An interactive toy telephone according to the present invention includes a handset having a microphone, speaker, and CPU positioned therein. A memory module is connected to the CPU and defines message storage locations. The handset includes a keypad with a plurality of keys associated with message storage locations. Upon actuation, a recording module in the handset enables an audio message to be recorded in a memory location selected by a user using the keypad. A plurality of illustrations or pictures may be removably positioned on the keypad, such that the identity of a person associated with particular recorded messages may be readily recalled. Upon another actuation of a key associated with a memory location, a previously recorded message may be played back through the handset speaker. In addition, the handset may be interfaced with a conventional telephone base or telephone line for receiving telephonic signals, such signals being emitted through the handset speaker and being recorded in a keypad selected memory location upon actuation of the recording module.

The CPU may be programmed to operate educational games using recorded messages, such as emitting a message randomly selected from the memory module and then congratulating a user if he appropriately identifies the corresponding memory location using the keypad. The CPU may also be programmed to offer a congratulatory message if a user correctly enters a telephone number of the person associated with a selected key.

Therefore, a general object of this invention is to provide an interactive toy telephone that interfaces with a conventional telephone base or telephone line, whereby telephonic signals may be received and emitted by the handset.

Another object of this invention is to provide an interactive toy telephone, as aforesaid, which can record an audible message of a person holding a toy phone handset upon actuation of a recording module and selection of a memory location in which the message is to be stored.

Still another object of this invention is to provide an interactive toy telephone, as aforesaid, which can record an audible message of a person remote from the handset when the handset is interfaced with a conventional telephone base or line.

Yet another object of this invention is to provide an interactive toy telephone, as aforesaid, in which pictures or illustrations may be removably positioned on a handset keypad for identifying the person associated with a recorded message.

A further object of this invention is to provide an interactive toy telephone, as aforesaid, in which the handset includes a tactile construction that is easily gripped by a user.

A still further object of this invention is to provide an interactive toy telephone, as aforesaid, that selectively emits a message randomly selected from its memory and provides a congratulatory message upon an appropriate response by a user.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

An interactive toy telephone 10 according to a preferred embodiment of the present invention will now be described in detail with reference to FIGS. 1 through 9 of the accompanying drawings. The toy telephone 10 includes a handset 12 having a generally rectangular configuration with aesthetically pleasing beveled corners and other curvatures (FIG. 1), although any configuration that resembles the handset of a conventional telephone would also be suitable. The handset 12 is preferably constructed of a durable plastic material and includes an external or "over-molding" layer 17 having a thermoplastic construction that is soft, tactile, and easy to grip. Therefore, while the handset 12 is durable, it can be easily manipulated by a child and dampens sound if dropped.

Figure 4:
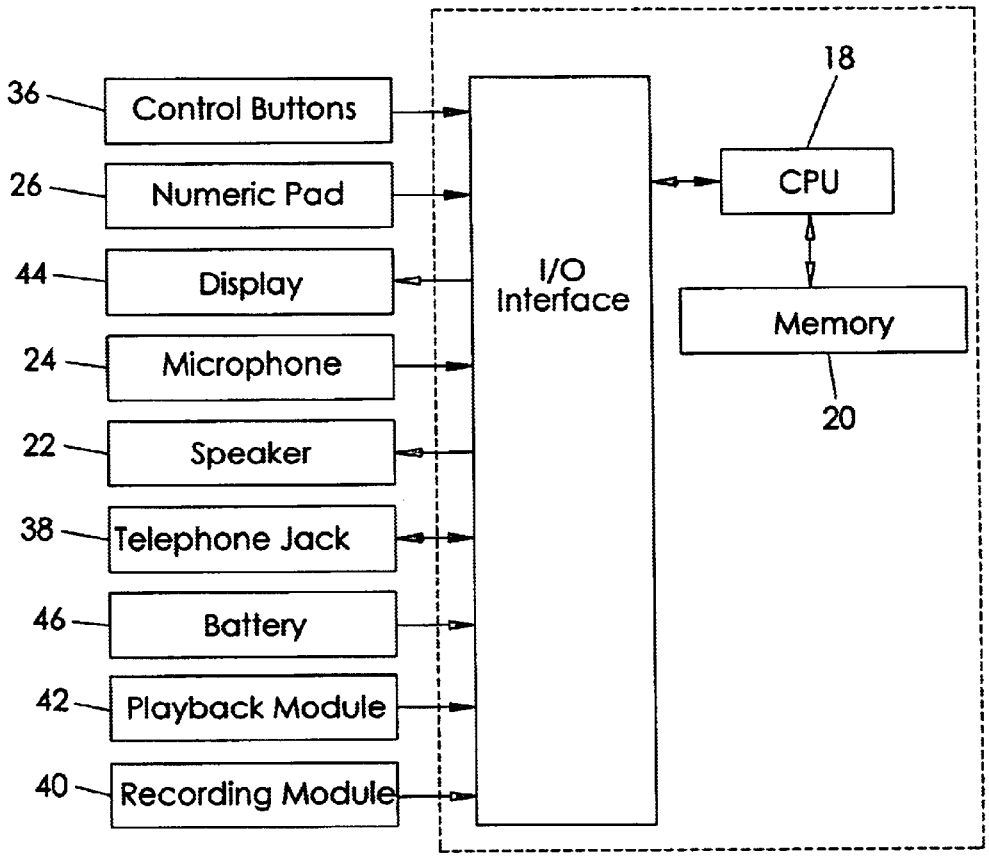
FIG. 4 is a block diagram illustrating the major electronic components housed in the toy telephone shown in FIG. 1.

The handset 12 includes first 14 and second 16 ends and defines an interior space in which electronic components are situated. More particularly, a central processing unit ("CPU") 18 is positioned in the interior space of the handset 12 and is electrically connected to a memory module 20 (FIG. 4). The memory module 20 defines a plurality of memory locations for the storage of digital messages, whether audio, alphanumeric, graphical, or other forms of digital data. It is understood that each memory location may be capable of storing audible messages greater than 10 seconds in audible length. A speaker 22 is positioned in the interior space of the handset 12 adjacent the first end 14 and is electrically connected to the CPU 18 (FIG. 4). It is understood that the CPU 18 may be programmed to include a variety of ring tones for emission through the speaker 22. Similarly, a microphone 24 is positioned in the interior space of the handset 12 adjacent the second end 16 and is electrically connected to the CPU 18. In addition, a battery 46 may be positioned in the interior space and connected to the CPU 18 so as to power the electronic components (FIG. 4).

Figure 1:
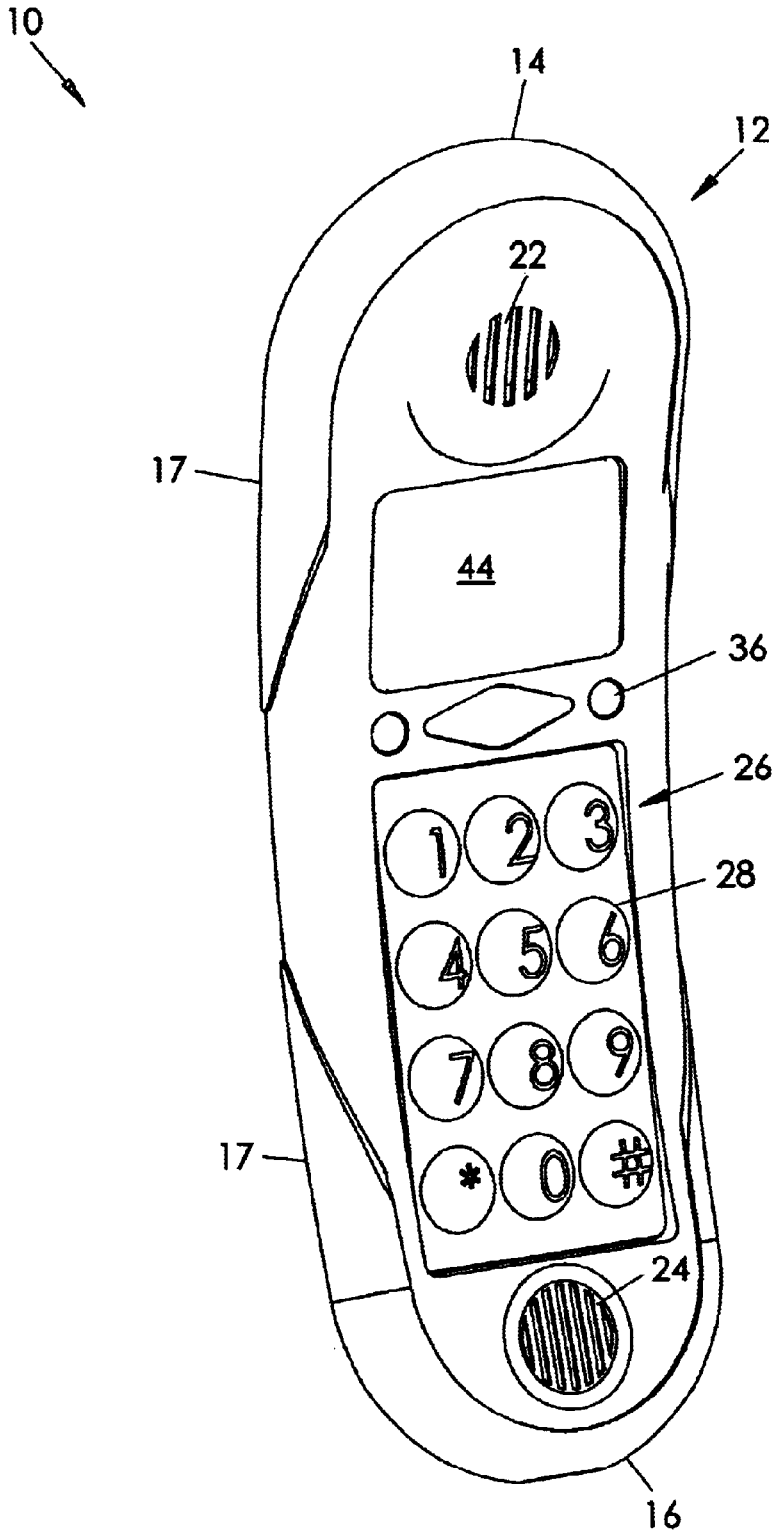
FIG. 1 is a perspective view of an interactive toy telephone according to a preferred embodiment of the present invention.
Figure 2:
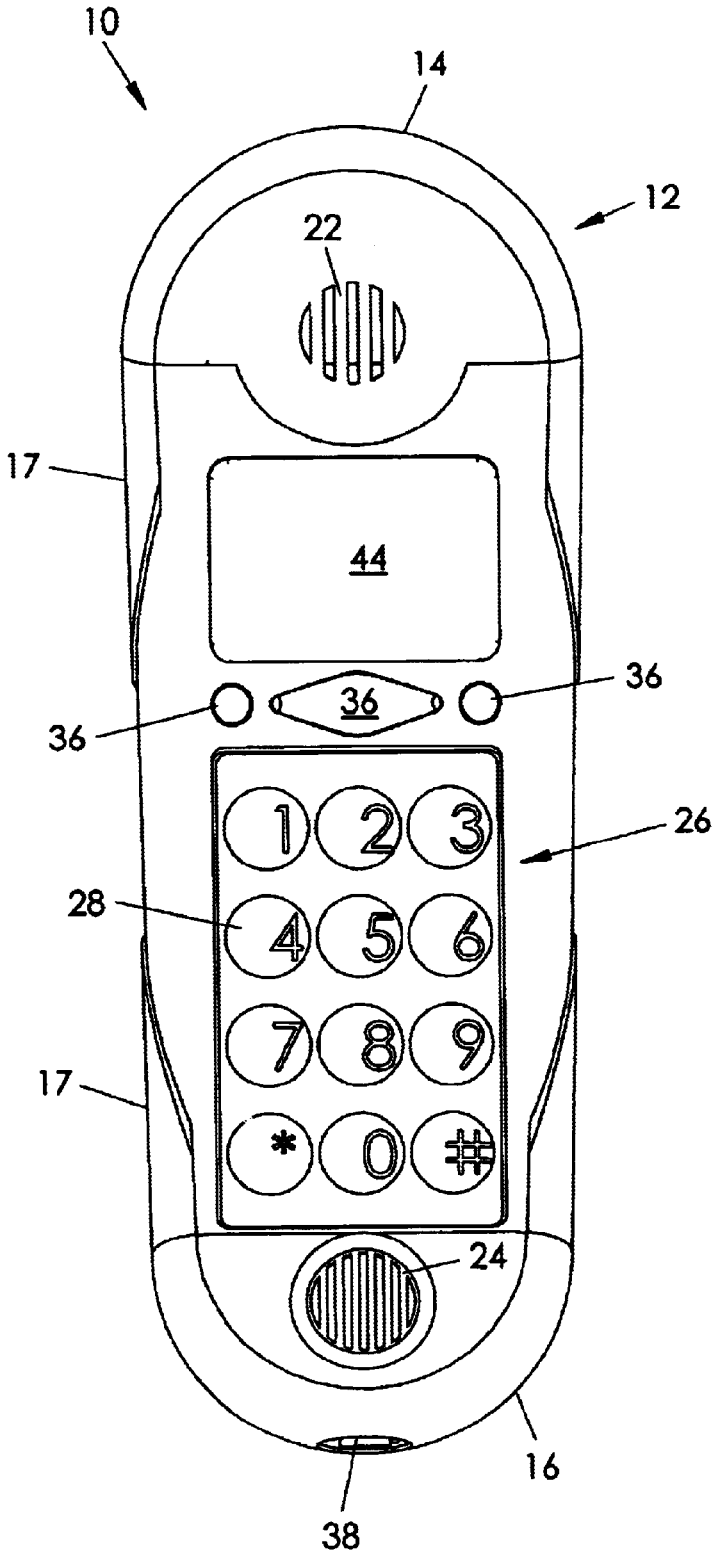
FIG. 2 is a front view of the toy telephone as in FIG. 1.
Figure 3:
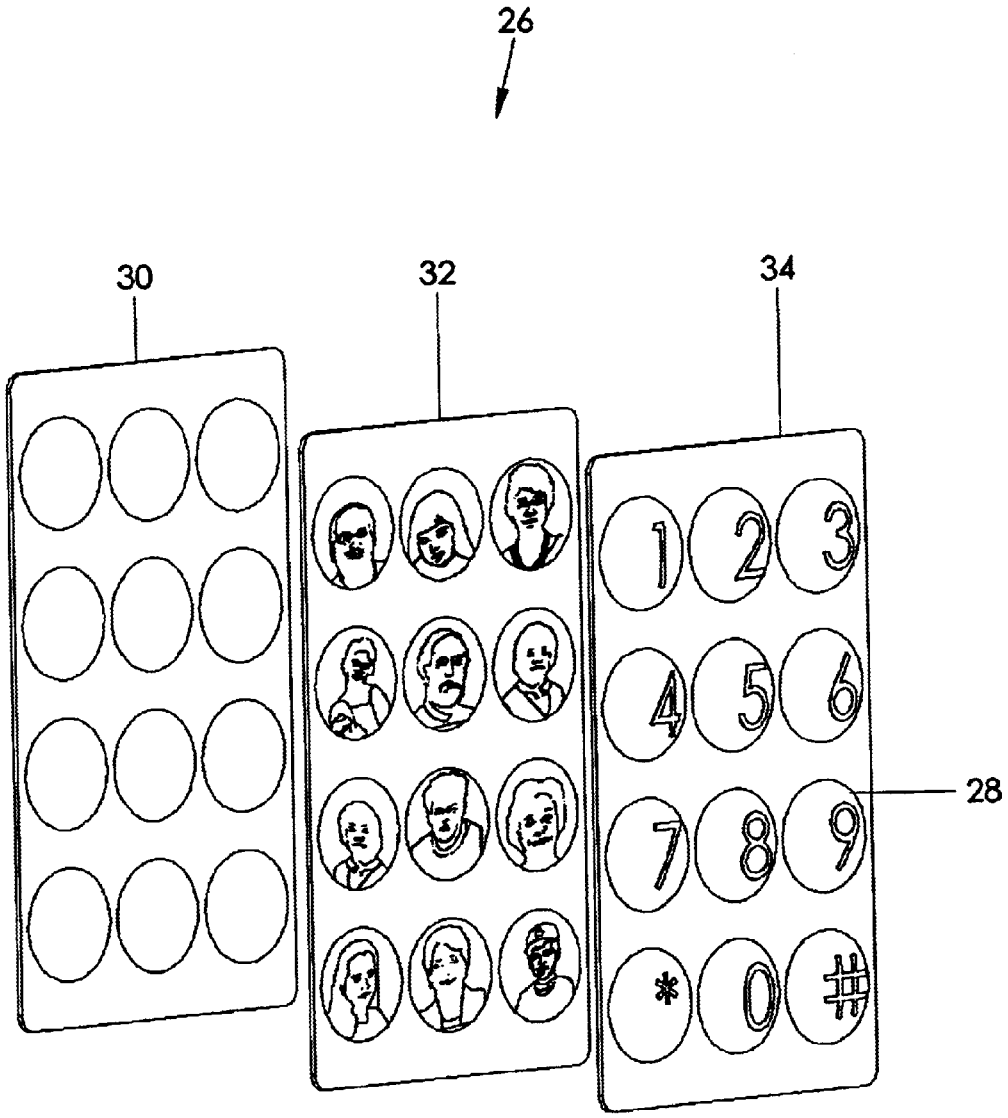
FIG. 3 is an exploded view of the keypad assembly as in FIG. 1.
Figure 5:
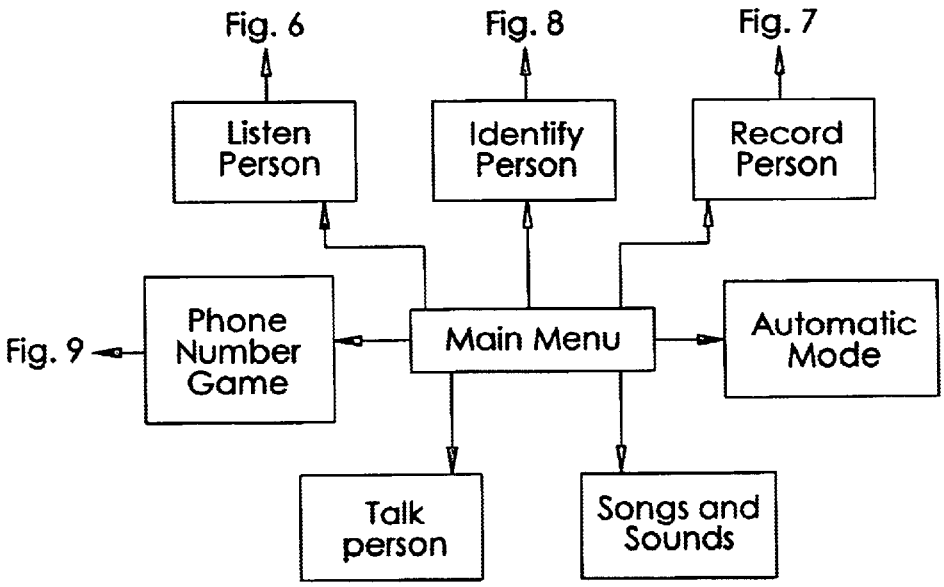
FIG. 5 is an illustration of a menu control screen displayable on a digital display as in FIG. 1.

A keypad 26 having a plurality of manually manipulable keys 28 is positioned on the handset 12 intermediate the first 14 and second 16 ends thereof (FIG. 1). The keypad 26 is an assembly including a base layer 30 having a plurality of membrane buttons, each button being connected to the CPU 18 and being associated with a predetermined memory location of the memory module 20. The keypad 26 further includes a top layer 34 constructed of a semi-flexible transparent material. An intermediate layer 32 may be situated between the top 34 and base 30 layers. The intermediate layer 32 is selectively removable by first removing the top layer 34. The intermediate layer 32 may include a plurality of user-selected images, illustrations, or drawings. These illustrations aid a user in remembering whose voice is recorded and associated with a particular number on the keypad 26, as will be described in greater detail later. The keyboard assembly and, more particularly, the intermediate layer 32 may snap securely in place such that it is not easily removable by young children. Additional control buttons 36 are also included on the handset 12 in communication with the CPU 18 for activating various predetermined functions, as described below. A representation of modes is shown in FIG. 5.

The toy telephone 10 includes a telephone jack 38 along with associated conventional telephone circuitry such that the handset 12 may be interfaced with a conventional telephone base unit or a conventional telephone line. In either case, normal telephone communications may occur using the toy telephone 10. Alternatively, the handset 12 may be connected to a computer network for downloading audio or graphical data into a selected memory location. It is understood that the phone jack 38 may be covered with a door or cover (not shown) when not in use for safety purposes.

Figure 7:
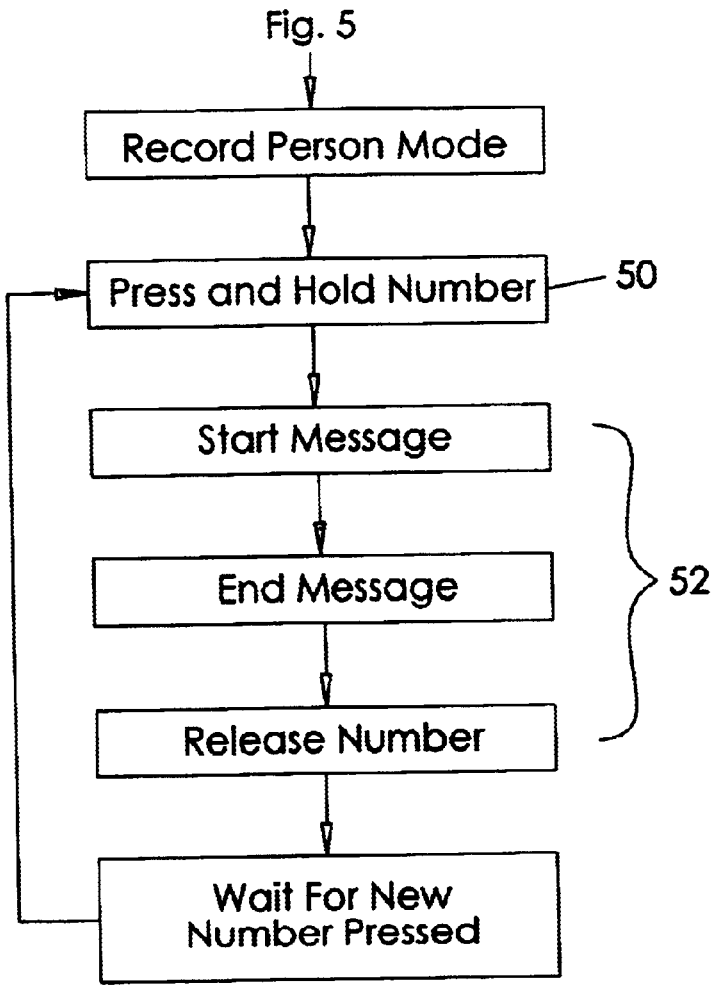
FIG. 7 is a flow diagram of a "record" mode operation.

A recording module 40 is also positioned in the handset 12 and is electrically connected to the keypad 26 and CPU 18. A user may actuate a key 28 of the keypad 26 associated with a desired memory location so as to activate the recording module 40, as indicated at block 50 (FIG. 7). It is understood that a control key 36 or other predetermined keystroke may be necessary to activate this mode. Then, the recording module 40, via its communication with the CPU 18, allows a voice message of a person holding the handset 12 to be written to the selected memory location, as indicated by reference numeral 52 (FIG. 7). In this instance, the microphone 24 would provide the user input interface. Or, the recording module 40 causes the message of a remote speaker to be recorded into the selected memory location, the speaker 22 serving as the input interface.

Figure 6:
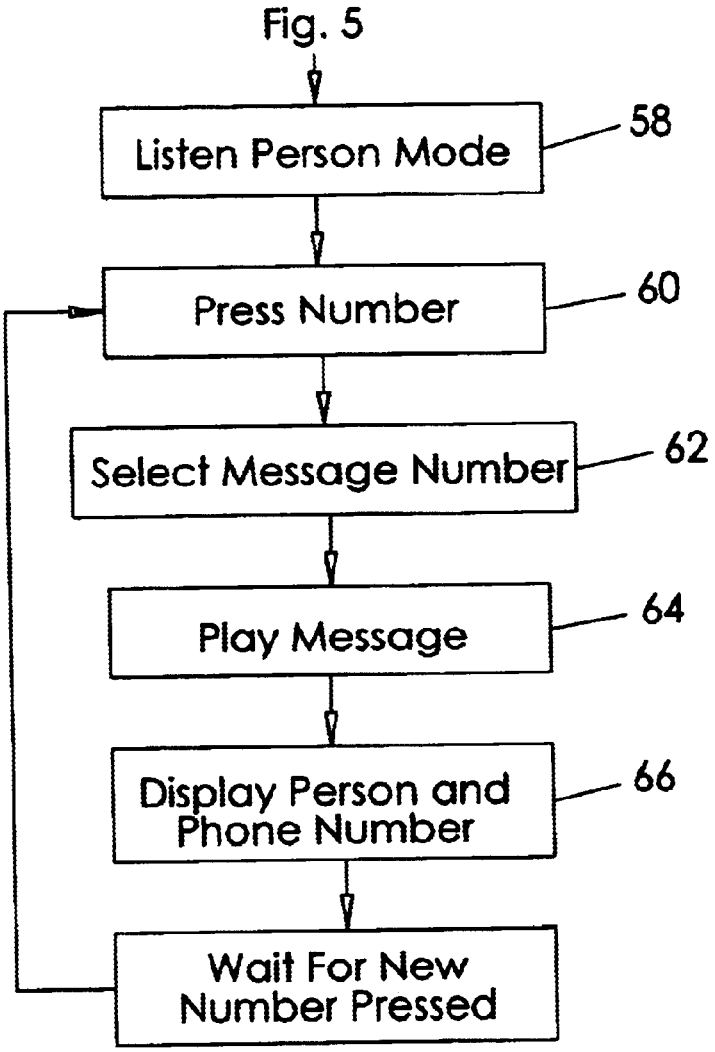
FIG. 6 is a flow diagram of a "listen" mode operation.

Further, a playback module 42 is positioned in the handset 12 for emitting an audio message stored in the memory module 20 through the speaker 22. More particularly, a predetermined control key 36 or other keystroke may be pressed 58 by a user to activate the playback mode (FIG. 6). Then a user may press a key 28 of the keypad 26 that is associated with a person's voice that has been previously recorded in an associated memory location, as indicated at block 60. The pictures on the keypad enable a user to select the correct number to hear the voice of a desired person, as indicated at block 62. As the playback module 42 is electrically connected to the CPU 18 and keypad 26, the appropriate message is retrieved from the associated memory location and emitted through the speaker 22, as referenced at block 64. A phone number associated with the selected message and memory location may also be displayed 66, the phone number having been previously entered and stored by the recording module 40.

A digital display 44 is mounted to the handset 12 and is electrically connected to the CPU 18 for displaying alphanumeric or graphical digital data. Data for display includes mode selection options, status messages, alerts, or game prompts, as to be described later. The modes represented in FIG. 5 may be displayed by the digital display 44. For example, graphical data may be displayed upon actuation of the playback module. Such data may be predetermined or recorded by a user through a telephone or computer network interface with the handset 12.

Figure 8:
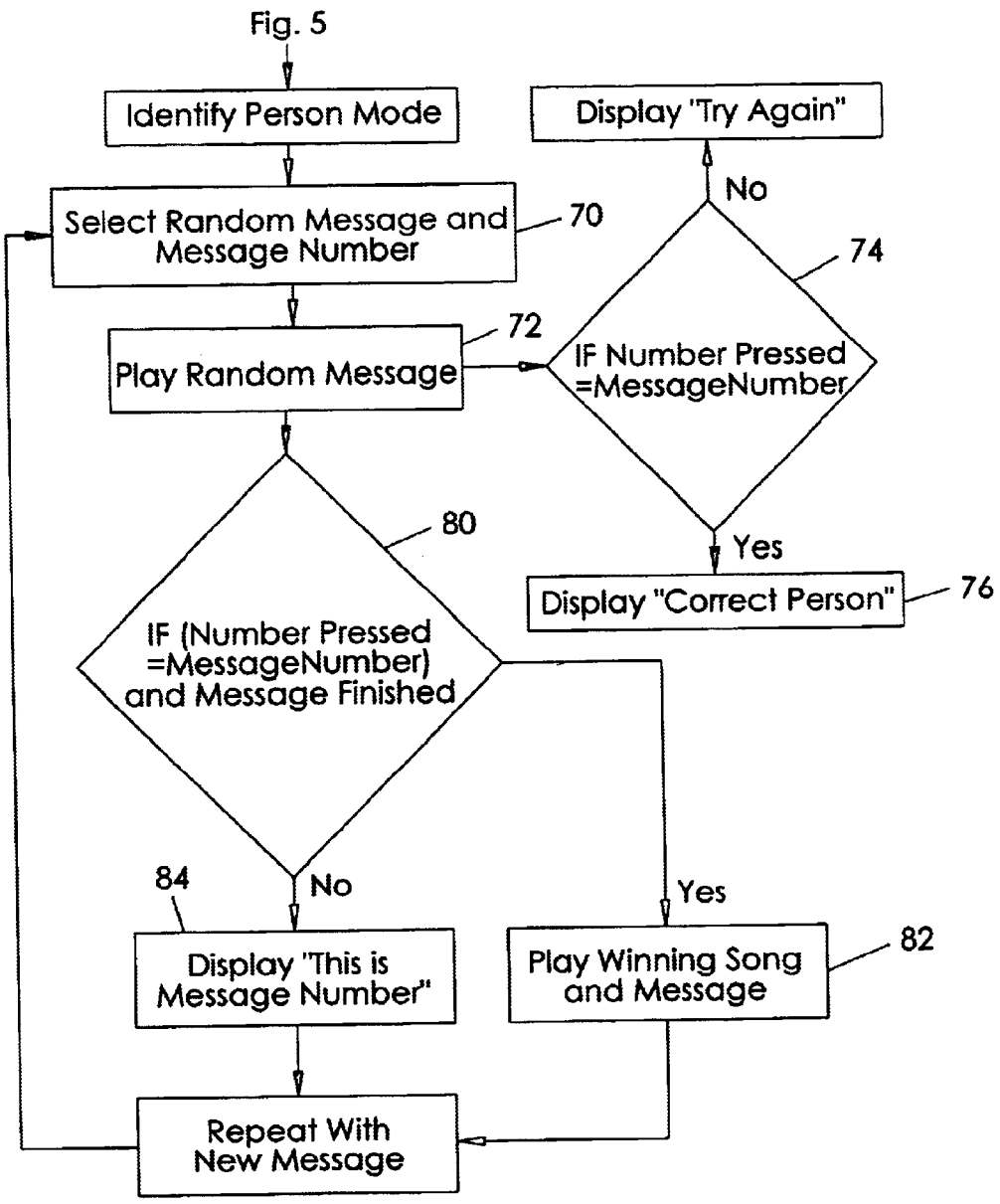
FIG. 8 is a flowchart showing the logic of an "identify person" educational game operation of the toy telephone.

In addition to the functions described above, the CPU 18 is programmed to provide predetermined game modes. The "identify person" game mode may be selected using the control keys 36 and the logic performed in this mode is illustrated in FIG. 8. In this mode, a stored message is randomly selected 70 by the CPU 18 and played 72 by the playback module 42 through the speaker 22. While the message is still playing, the CPU 18 checks 74 whether a user depresses a key 28 corresponding to the memory location of the randomly selected message, as shown at block 72. If so, the CPU 18 will direct an encouraging message to be emitted 76. Otherwise, a "try again" message is emitted 78. The CPU also checks a user's response after the message has completely played 80. If the user presses the correct key when the message has finished, a commendatory response is emitted 82. Otherwise, the CPU 18 will cause a message to be emitted which identifies the correct message number 84.

Figure 9:
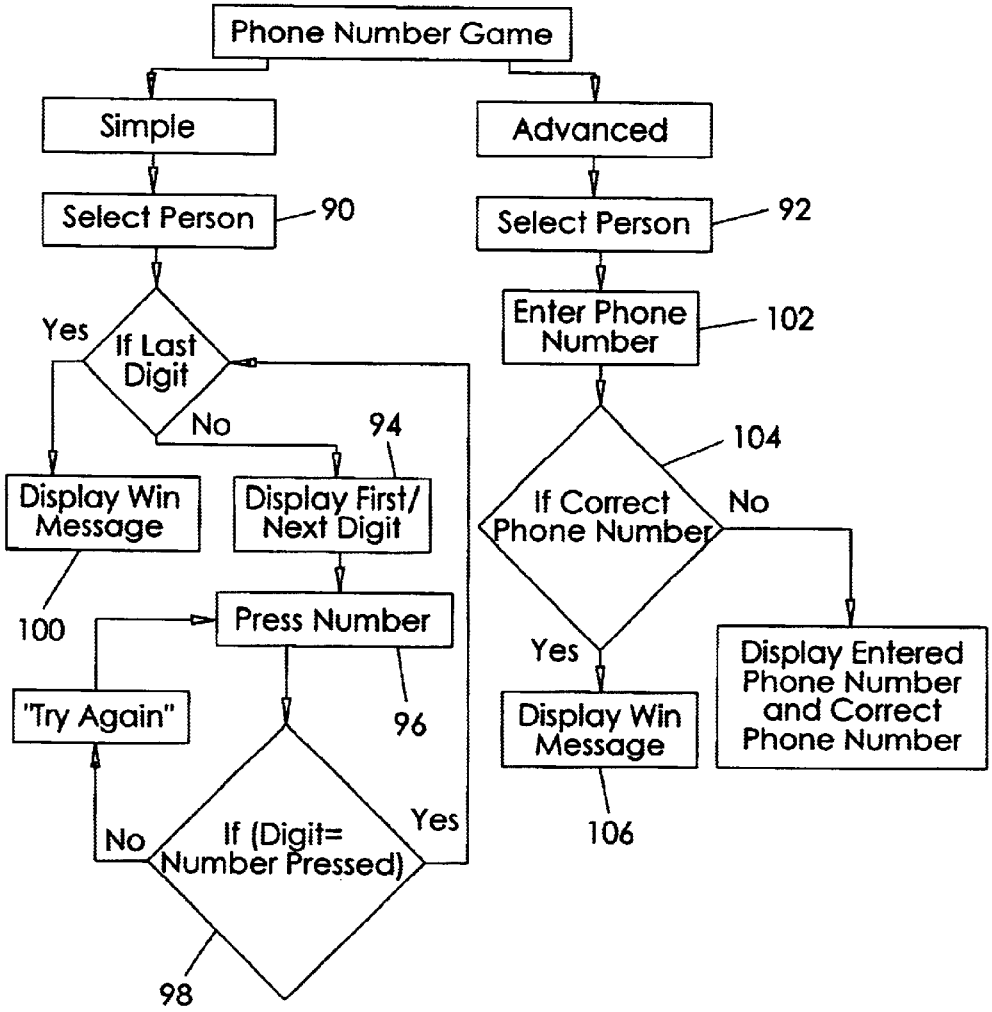
FIG. 9 is a flowchart showing the logic of an "identify phone number" educational game operation of the toy telephone.

The "identify phone number" game is illustrated in FIG. 9 and may also be activated using the control keys 36. In this game, the telephone number of each person who has recorded an audible message is also stored in memory. Presumably, the telephone number was entered at the time of recording the audible message. In this mode, the user selects a person shown on the keypad 26 by pressing a corresponding numeric key 28, as indicated at blocks 90 and 92 (FIG. 9). In a simple version of the game, the CPU 18 prompts the user with a next digit 94 in the phone number, either audibly or visually on the digital display. The user may press the indicated number 96 and, if the correct digit is pressed 98, the next digit is displayed, and so on. When all digits of the phone number have been correctly pressed, a congratulatory message is emitted 100. In a more advanced version of the same game, the user must enter the entire telephone number without prompting 102. If correct 104, a congratulatory message is emitted 106.

The CPU 18 may also be programmed to perform other modes. Specifically, a "special record mode" (not shown) would allow a user (child) to record his own message to share with an adult at a later time. For example, a child may record "Grandma, I just won the game. I wish you were here!" Of course, this user-recorded message may be in response to a previously stored message. This mode would be activated using the control keys 36 and would involve actuation of the recording module 40 as described previously. Further, the CPU 18 may include an "automatic mode" (FIG. 5) in which a time may be associated with a stored message such that the playback module 42 will be automatically activated at that time to ring the handset 12 and playback the stored message. This mode is desirable, for instance, for a traveling parent to deliver a "goodnight" message to a child.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. An interactive toy phone, comprising:

a handset having a microphone and a speaker positioned therein;

memory means defining a plurality of message storage locations for storing audio messages, said memory means being electrically connected to said microphone and said speaker;

a keypad on the handset having a plurality of manually manipulable keys, each key being electrically connected to a corresponding message storage location;

means for recording audio messages in said message storage locations upon a first predetermined actuation of a respective key, said means for recording being electrically connected to said keypad and said memory means;

audio playback means electrically connected to said keypad, said message storage locations, and said speaker for emitting a recorded audio message through said speaker upon a second predetermined actuation of a corresponding key; and means for interfacing said handset with a conventional telephone base unit for receiving telephonic signals from said base unit into said handset for emission through said speaker, said telephonic signals received from said base unit being recorded in a respective message storage location upon actuation of said recording means.

2. The interactive toy telephone as in claim 1 further comprising means for interfacing said handset with a conventional telephone line for receiving telephonic signals from said telephone line into said handset for emission through said speaker, said telephonic signals received from said telephone line being recorded in another respective message storage location upon actuation of said recording means.

3. The interactive toy telephone as in claim 1 further comprising network interfacing means for interfacing said handset with a wide-area computer network for receiving audio message digital data, said network interfacing means being electrically connected to said message storage locations for storing said audio message digital data in a selected message storage location.

4. The interactive toy telephone as in claim 1 wherein said keypad includes means for removably receiving a plurality of illustrations.

5. The interactive toy telephone as in claim 1 further comprising a digital display positioned on said handset for displaying predetermined mode data and messages.

6. The interactive toy telephone as in claim 1 wherein said handset includes a casing having a thermoplastic overmolding construction that is generally soft, tactile, and grippable.

7. The interactive toy telephone as in claim 1 further comprising a first game means for actuating said playback means to emit a recorded audio message randomly selected from said message storage locations, said first game means including means for communicating a congratulatory message when a selected key of said keypad corresponding to said randomly selected recorded audio message is pressed.

8. The interactive toy telephone as in claim 1 further comprising a second game means for receiving a user-selection of a respective key associated with a corresponding memory storage location, said second game means including means for communicating a congratulatory message when a series of keys of said keypad are pressed which correspond sequentially to a telephone number associated with said corresponding memory storage location.

9. The interactive toy telephone as in claim 1 further comprising a third game means for actuating said playback means to emit a recorded audio message randomly selected from said message storage locations, said toy telephone further comprising auxiliary recording means for recording a responsive message in another message storage location associated with said randomly selected recorded audio message.

10. An interactive toy telephone, comprising:

a handset defining an interior space and having a microphone and a speaker positioned therein, said handset having an external layer of thermoplastic material that is soft and tactile;

a CPU positioned in said interior space of said handset and being electrically connected to said microphone and said speaker;

a memory module positioned in said interior space and defining a plurality of message storage locations for storing audio messages, said memory module being electrically connected to said CPU;

a keypad on the handset having a plurality of manually manipulable keys, said CPU including means for associating said keys with corresponding message storage locations;

wherein said keypad includes means for removably receiving a plurality of illustrations;

means for recording audio messages in said message storage locations upon a first predetermined actuation of a respective key, said means for recording being electrically connected to said keypad and said CPU;

an audio playback module electrically connected to said CPU for emitting a recorded audio message through said speaker upon a second predetermined actuation of a corresponding key;

a digital display electrically connected to said CPU for displaying predetermined mode and message data associated with said message storage locations; and means for interfacing said handset with a conventional telephone line for receiving telephonic signals from said telephone line into said handset for emission through said speaker, said telephonic signals being recorded in another respective message storage location upon actuation of said recording means.

11. The interactive toy phone as in claim 10 further comprising means for interfacing said handset with a conventional telephone base unit for receiving telephonic signals from said base unit into said handset for emission through said speaker, said telephonic signals from said telephone line being recorded in a respective message storage location upon actuation of said recording means.

12. The interactive toy phone as in claim 11 further comprising network interfacing means for interfacing said handset with a wide-area computer network for receiving digital data, said network interfacing means being electrically connected to said CPU for storing said digital data in a selected message storage location upon actuation of said recording means.

13. The interactive toy phone as in claim 10 wherein:

said telephonic signals include alphanumeric and graphical digital data; and said digital display is adapted to display graphical digital data stored in said message storage locations upon said second actuation of said corresponding key.

14. The interactive toy phone as in claim 10 wherein said means for removably receiving a plurality of illustrations comprises:

a base layer having a plurality of membrane buttons that electrically connect said keypad to said CPU;

a top layer constructed of a semi-flexible transparent material; and an intermediate layer removably situated between said base and top layers, said intermediate layer having a plurality of user-selected illustrations or pictures thereon.

15. The interactive toy phone as in claim 10 wherein said CPU includes:

means for actuating said playback module to emit a recorded audio message randomly selected from said message storage locations; and means for communicating a congratulatory message when a selected key of said keypad corresponding to said randomly selected recorded audio message is pressed.

16. The interactive toy phone as in claim 10 wherein said CPU includes:

means for user selection of a particular message storage location; and means for communicating a congratulatory message when a series of keys of said keypad are pressed which correspond sequentially to a telephone number associated with said selected memory storage location.

17. The interactive toy phone as in claim 10 wherein said CPU includes:

means for actuating said playback module to emit a recorded audio message randomly selected from said message storage locations; and said interactive toy phone further comprising auxiliary recording means for recording a responsive message in another message storage location associated with said randomly selected recorded audio message.

18. The interactive toy phone as in claim 10 wherein said CPU comprises:

means for actuating said playback module to emit a recorded audio message randomly selected from said message storage locations;

means for communicating a congratulatory message when a selected key of said keypad corresponding to said randomly selected recorded audio message is pressed; and means for communicating another congratulatory message when a series of keys of said keypad are pressed which correspond sequentially to a phone number stored in a memory storage location associated with said randomly selected audio message.

* * * * *